United States Patent [19]

VanZandt

[11] 4,373,632

[45] Feb. 15, 1983

[54] NAIL POLISH HANGER

[76] Inventor: John M. VanZandt, 15932 Northfield, Pacific Palisades, Calif. 90272

[21] Appl. No.: 236,288

[22] Filed: Feb. 19, 1981

[51] Int. Cl.[3] ..... B65D 73/00

[52] U.S. Cl. ..... 206/457; 206/806; 206/81; 248/359

[58] Field of Search ..... 206/457, 806, 81, 471; 215/228; 220/212, 376; 229/74; 40/310, 311; 248/359, 360, 317; 434/99, 100

[56] References Cited

U.S. PATENT DOCUMENTS

| | | | |
|---|---|---|---|
| 2,340,900 | 2/1944 | Robinson | 434/100 |
| 3,070,906 | 1/1963 | Tinsley | 434/100 |
| 3,370,733 | 2/1968 | Giesler | 206/806 X |
| 3,404,774 | 10/1968 | Levine | 206/471 |
| 3,764,002 | 10/1973 | Spiegel et al. | 206/471 |

FOREIGN PATENT DOCUMENTS

| | | | |
|---|---|---|---|
| 440039 | 3/1926 | Fed. Rep. of Germany | 248/360 |

*Primary Examiner*—William Price
*Assistant Examiner*—Brenda J. Ehrhardt
*Attorney, Agent, or Firm*—Poms, Smith, Lande & Rose

[57] ABSTRACT

An apparatus for suspending a bottle of nail polish having a removable cap from a display bar includes a sheath which is attached to and encircles the cap, and which also defines a sheath aperture over the cap. A hanger attached to the sheath aperture rotatably suspends the sheath and the bottle from the display bar, with a portion of the hanger being cut away for positioning over the bar. The color of the nail polish in the bottle is indicated with a generally planar and oval disc of the same color as the nail polish and attached to the hanger. The sheath may extend vertically downward along the bottle to expose only the contents in the bottom thereof, and the entire apparatus may be made of plastic.

5 Claims, 7 Drawing Figures

PRIOR ART Fig. 1.
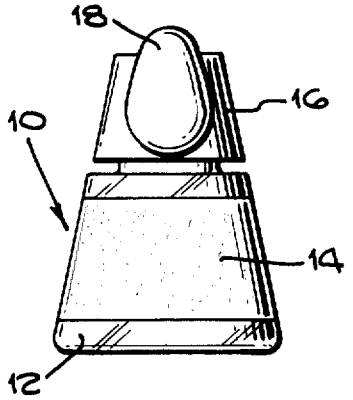
Fig. 4.
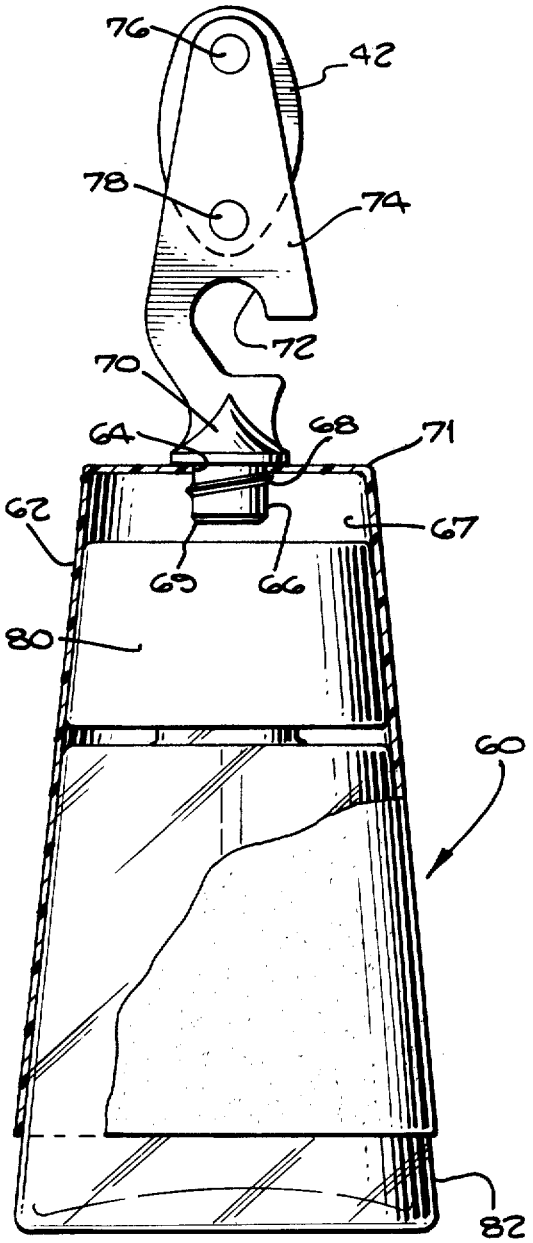
Fig. 5.
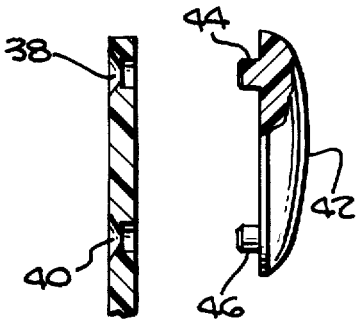
Fig. 6.
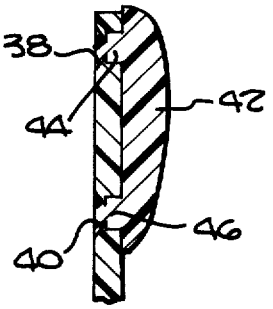

NAIL POLISH HANGER

FIELD OF THE INVENTION

The present invention relates generally to apparatus for suspending containers and, in particular, relates to apparatus for suspending cosmetic containers such as nail polish bottles.

BACKGROUND OF THE INVENTION

Cosmetic containers, such as nail polish bottles, are generally designed for display on shelves. Accordingly, most cosmetic containers simply consist of a bottle or the like and a removable cap. As many product displays have the capability to suspend cosmetics from display bars or posts, a cosmetic container having simply a bottle with a removable cap is somewhat limited to being displayed just upon a shelf. The prior art does not teach a display apparatus for a cosmetic container, such as a bottle of nail polish, which will allow the container either to be set upon a shelf or rotatably suspended from a display bar. If a cosmetic container could be either hung vertically or supported from beneath, the handling of the container through the manufacturing, shipping and display stages would be greatly facilitated.

Furthermore, with particular regard to nail polish containers, most of such containers indicate the color of the nail polish therein by a printed label on the bottle or on a fingernail-shaped member glued to the cap. Both approaches present several disadvantages. First, both the label and nail are subject to color fade, thereby misleading the consumer as to the true color of the contents in the bottle. Secondly, such an arrangement requires different labels for each color, thereby requiring extra work during the packaging of the nail polish to ensure that the correct label ends up on the right bottle. A more accurate means of indicating the color of the nail polish would be advantageous especially if the number of different labels for a manufacturers line could be reduced.

A further problem with the prior art nail polish bottles is that the label of the bottle typically allows the purchaser to view the entire contents of the bottle. Unfortunately, while sitting on a shelf, the lacquer and pigment portions of nail polish frequently separate. As a result the consumer does not buy the nail polish, believing it to be old and unusable. In reality, the nail polish can be quickly remixed by simply shaking the bottle after purchase. However, the separation of the contents tends to be a visual barrier against the purchase of the product. Accordingly, it would be advantageous if the bottle was covered in a manner whereby only the bottom portion of the nail polish (containing the separated pigment) is exposed. Thus, the consumer would buy the bottle, and then reshake it before use, never knowing that the material was separated.

Accordingly, it is the principal object of the present invention to allow a cosmetic container to be either vertically and rotatably suspended from a display bar or displayed on a shelf.

Yet another object of the present invention is to facilitate the handling of cosmetic containers during the manufacturing, packaging, and display stages.

It is another object of the invention to display primarily the bottom portion of a container of cosmetics.

A further object of the invention is to provide an indication of the contents of the cosmetic container in a manner which provides an accurate indication of the contents of the container, and in a manner which can be quickly changed.

SUMMARY OF THE INVENTION

The present invention, in a broad aspect, provides an apparatus for suspending a container from a cap removably attached to the container, which apparatus includes a sheath encircling the cap which attaches the apparatus to the container, and also a hanger attached to the sheath which rotatably suspends the sheath and the container from a point of support.

The sheath can include a generally thin and rigid shroud enclosing the top and side portions of the cap, with the shroud being attached to the sides of the cap and forming a chamber having a central bore over the cap. The hanger can include an elongated member having a flange at one end and a threaded member projecting from the flange, whereby the hanger is attached to the sheath by urging the threads on the threaded member into the sheath bore, whereupon the shroud is disposed for free rotation between the flange and the threads.

Alternately, the hanger can include an elongated member having a flange at one end and a post with a pair of outwardly biased and moveable arms projecting from the flange. With this configuration, the hanger is attached to the sheath by urging the post through the sheath bore, thereby forcing the arms together. When the post is completely in the bore, the arms move apart, whereupon the shroud is disposed for free rotation between the flange and the upper end of the arms.

In accordance with one feature of the invention, a generally plastic and oval disk can either be coated with the contents of the container and snapped onto the hanger, or can be molded of a material of the same color as the contents of the container, thereby indicating the color of the container contents.

In accordance with a further feature of the invention, the shroud can extend past the cap to encircle all of the lower portion of the container, thereby exposing only the contents in the lower portion of the container.

Other objects, features, and advantages of the present invention will become apparent from a consideration of the following detailed description and from the accompanying drawings.

BRIEF DESCRIPTION OF THE DRAWINGS

FIG. 1 shows a side view of a prior art cosmetic container such as nail polish bottle;

FIG. 4 shows an alternate embodiment of the present invention;

FIGS. 5 and 6 show side views, partially in cross section, of the attaching of a disc coated with the contents of the cosmetic container to the apparatus shown in FIGS. 2, 3 and 4.

DETAILED DESCRIPTION

Figure 2:
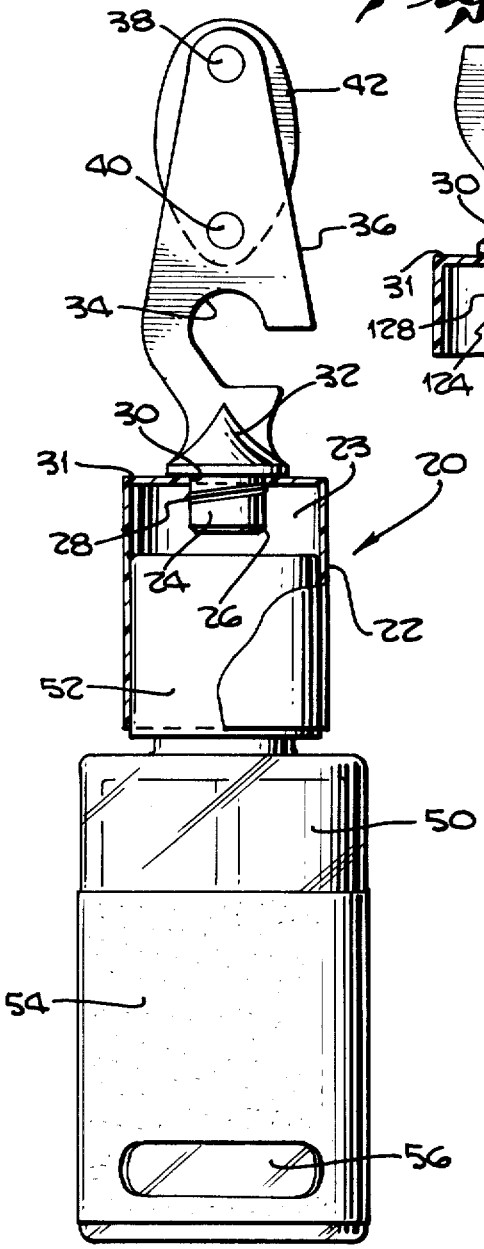
FIG. 2 shows a side view, partially in cross section, of an apparatus according to the present invention for suspending a cosmetic container, such as a nail polish bottle.

Referring more particularly to the drawings, FIG. 1 shows a prior art cosmetic container 10 of the type used to hold nail polish. The container 10 includes a bottle 12 and a removable cap 16. The bottle 12 has a label 14 attached thereto which may have printed thereon a color representative of the contents of the bottle 12. If the label 14 does not have printed indicia thereon representative of the color of the nail polish, a fingernail-shaped member 18 is often attached to the cap 16 and labeled appropriately.

The primary limitations of the prior art container 10 is that it may only be displayed upon a shelf. Furthermore, the printed indicia on the label 14 (or the nail 18) representative of the contents of the bottle 12 is subject to fading and therefore loses its resemblance to the nail polish pigment. Also, the position of the label 14 is often such that the entire contents of the bottle may be viewed which, as mentioned, allows the separated pigment and lacquer to be seen by the purchaser, thereby creating an incorrect impression that the nail polish is no longer usable.

Figure 3:
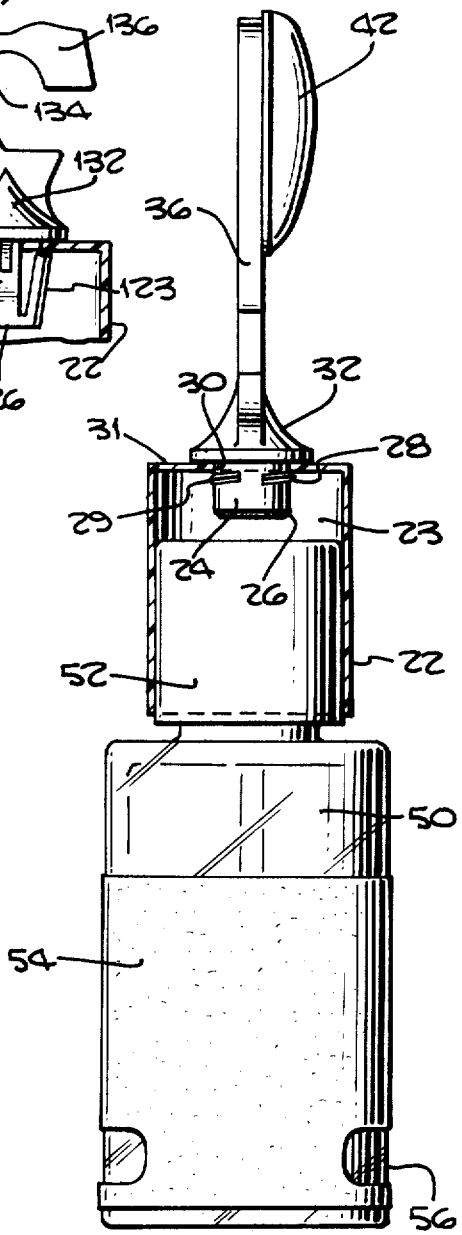
FIG. 3 shows a side view of the apparatus shown in FIG. 2.

FIGS. 2 and 3 show an apparatus 20 according to the present invention for rotatably suspending a cosmetic container 50 by its removable cap 52. As shown therein, the apparatus 20 comprises a sheath portion 22 and a hanger portion 36. The sheath portion 22 encircles the cap 52 and creates a closed chamber 23 over the cap 52. The chamber 23 is provided with a bore 30. The sheath 22 may be attached to the cap 52 by gluing, compression or any other convenient means. The sheath 22 is preferably a thin rigid member made out of plastic material such as styrene.

The hanger portion 36 is a thin and elongated member having a generally rounded flange 32 at one end and having a cutaway portion 34 for hanging over a display bar or the like. Projecting from the flange 32 is a generally cylindrical member 24 having at least two threads 28 and 29. The end 26 of the member is chamfered. As is the case with the sheath member 22, the hanger 36 may be made of plastic material such as styrene.

The hanger 36 is affixed to the sheath 22 by urging the threads 28 and 29 on the cylindrical member 24 past the bore 30 in the top of the sheath. The chamfered edge 26 aids entry of the cylindrical member 24 into the bore 30. This results in the threads 28 and 29 snapping into the chamber 23 formed above the cap 52 by the sheath 22. Once the threads 28 and 29 have been snapped past the bore 30, the hanger 36 is free to rotate relative to the sheath 22. To enhance the apparatus 20, the bore 30 is generally circular and of a diameter approximately equal to that of the cylindrical member 26. Accordingly, a relatively close fit is achieved between the bore 30 and the cylindrical member 26 after the threads 28 and 29 have been urged therethrough.

Furthermore, the diameter of the bore 30 is less than that of the flange 32, thereby ensuring only rotative movement of the hanger 36 relative to the sheath 22. Also, the upper wall 31 of the sheath is relatively thin and of approximately the same thickness as the space between the threads 28 and 29 and the underside of the flange 32. This also produces a close fit between the sheath 22 and the hanger 36.

Various modifications can be made to the hanger 36 and the sheath 22 within the scope of the present invention. While both are preferably made of a plastic material such as styrene, other plastic materials, such as nylon, may also be used. Metallic materials may also be used. Furthermore, while FIGS. 2 and 3 show only two threads 28 and 29, more or less threads could be used as is compatible with manufacturing and assembly techniques. Also, the cutout 34 in the hanger 36 may be shaped differently to accommodate different types of display bars.

At the top portion of the hanger 36 are a pair of holes 38 and 40 for receiving a generally oval-shaped disc 42 having thereon a pair of bosses 44 and 46. This disc 42 has the general shape of a fingernail, so that it may be held over a purchaser's fingernail for evaluation of the nail polish. The disc 42 can have baked or painted thereon actual nail polish pigment. Alternately and preferably, the disc 42 can be molded of plastic material in the exact color of several (e.g. two) coats of dried nail polish. With either method, a highly accurate representation of the material in the bottle 50 will be visible at the top of the hanger 36. Furthermore, the use of the molded colored plastic provides a much more accurate indication of the true color of the nail polish than the wet color in the bottle.

As shown in FIGS. 5 and 6, the disc 42 is attached to the hanger 36 by snapping the bosses 44 and 46 into a part of apertures 38 and 40 on the hanger 36. This allows the hangers 36 and discs 42 to be manufactured separately without the need for knowing in advance the particular color of the nail polish in the bottle. That is, the placement of disc 42 with the proper color relating to the contents of the bottle 50 need only be done after the bottle has been filled and the hanger 36 and sheath 22 attached to the bottle. Accordingly, the process of filling and labelling the bottles should be more rapid.

As shown in FIGS. 2 and 3, a label 54 is attached to the bottle 50 and is provided with a pair of apertures 56 by which only the bottom portion of the bottle 50 is exposed, thereby showing only the pigment in the bottom of the bottle. Accordingly, the separated pigment and laquer is hidden, which will prevent customers from improperly believing the product in the bottle is unusable.

FIG. 4 shows an alternate embodiment 60 of the present invention. As with the embodiment shown in FIGS. 2 and 3, the invention shown in FIG. 4 is adapted for use with a bottle 82 having a removable cap 80. The apparatus 60 includes a sheath 62 encircling almost the complete bottle 82. The sheath 62 forms an open chamber 67 above the bottle cap 80. The sheath 62 is provided with a bore 64. Into the sheath 62 is inserted a hanger 74 having a flange 70 at one end. Projecting from the flange 70 is a generally cylindrical member 66 having at least one thread 68. The hanger 74 is provided with a cutaway portion 72 for placement over a display bar or the like. Additionally, an oval disc 42 as described hereinabove, either molded of colored plastic and or having baked thereon a color representative of the contents of the bottle, may be snapped onto the hanger 74 via two apertures 76 and 78.

To assemble the apparatus 60, the cylindrical member 66 is inserted into the bore 64 with the chamfered edge thereon 69 facilitating the correct placement. After the threads 68 are snapped past the bore 64, the hanger 74 is free to rotate. As before, the upper edge 71 of the hanger is relatively thin and of approximately the same thickness as the spacing between the flange 70 and the threads 68.

The primary difference between the embodiments shown in FIG. 4 and that shown in FIGS. 2 and 3 lies in the sheath 62. As with the previous embodiment, the sheath 62 is attached to the cap 80 by glue, compression, or other means. The sheath 62 covers almost the entire bottle 82 to expose only the bottom portion thereof.

Accordingly, all a purchaser of the bottle will see is either the mixed nail polish or the separated pigment.

Figure 7:
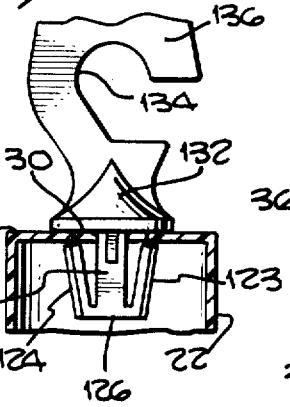
FIG. 7 shows a fragmentary sectional view of yet another embodiment of the present invention.

FIG. 7 shows an alternate embodiment 136 of the hanger portion of the present invention. As with the embodiment of the hanger shown in FIGS. 2, 3, and 4, the hanger 136 shown in FIG. 7 is a thin and elongated member having a generally rounded flange 132 at one end and having a cutaway portion 134 for hanging over a display bar or the like. The difference between the previous hanger embodiment and the embodiment of the hanger 136 shown in FIG. 7 is that the threaded cylindrical member projecting from the flange in the previous embodiment has been replaced with a post 128 having attached thereto a pair of outwardly biased arms 123 and 124. The post 128 and the arms 123 and 124 meet in a flattened surface 126 at the bottom of the hanger 136. The area of the bottom surface 126 is less than that of the bore 130 in the top portion of the sheath 22.

With the embodiment shown in FIG. 7, the hanger 136 is affixed to the sheath 22 by urging the arms 124 and 123 past the bore 130 at the top of the sheath. As the arms 123 and 124 enter the bore, they will be urged toward the post 128 by the edges of the bore 130. Once past the top of the sheath 122, the outward bias on the arms 123 and 124 will urge them outwardly and away from the post 128, thereby positioning the upper edge of the sheath 22 between the flange 132 and the arms 123 and 124 for free rotation relative thereto.

The outward bias on the arms 123 and 124 is achieved by molding them in the position shown in FIG. 7. As a result, the upper ends of the arms 123 and 124 may move inwardly to allow the hanger 136 to be attached to the sheath 22.

The thre alternate embodiments of the invention described hereinabove greatly facilitate the display of a cosmetic container such as a bottle of nail polish, and also provide a very attractive means of packaging the cosmetic. The present invention may be manufactured very inexpensively and assembled very rapidly, and has benefits for both the manufacturer and the purchaser of the cosmetic.

In the foregoing description of the present invention, two alternate embodiments of the invention have been disclosed. It is to be understood that other mechanical and design variations are within the scope of the present invention. Accordingly, the invention is not limited to the particular arrangement which has been illustrated and described in detail herein.

What is claimed is:

1. An apparatus for suspending a container from a cap removably attached to said container comprising:

(a) sheath means, encircling said cap, for attaching said apparatus to said container, said sheath means including a bore disposed over said cap; and (b) hanger means, rotatably attached to said sheath means at said bore and including an arcuate opening for positioning over a point of support, for rotatably suspending said sheath means and said container from said point of support, said hanger means including:

(1) a substantially flat and elongated member, having a cutaway area therein defining said arcuate opening;

(2) a flange disposed at one end of said elongated member, said flange being disposed adjacent said bore in said sheath means and being larger in area than said bore;

(3) a shaft member extending outwardly from said flange and having a cross section substantially identical to that of said bore, said shaft being positionable within said bore; and (4) thread means, disposed on said shaft, for maintaining said hanger means rotatably attached to said sheath means after said shaft member is placed in said bore and said thread means is urged past said sheath means.

2. An apparatus for suspending a container from a cap removably attached to said container comprising:

sheath means, encircling said cap, for attaching said apparatus to said container, said sheath means including a bore disposed over said cap;

hanger means, rotatably attached to said sheath means at said bore and including an arcuate opening for positioning over a point of support, for rotatably suspending said sheath means and said container from said point of support;

means, attached to said hanger means, for indicating the contents within said container, said indicating means including a generally planar and oval disc of the same color as said contents within said container; and means for attaching said indicating means to said hanger means, said attaching means including at least one boss extending from said disc and at least one aperture in said hanger means, whereby said disc is attached to said hanger means by urging said boss into aperture.

3. An apparatus for suspending a container from a cap removably attached to said container comprising:

(a) sheath means, encircling said cap, for attaching said apparatus to said container, said sheath means including a bore disposed over said cap; and (b) hanger means, rotatably attached to said sheath means at said bore and including an arcuate opening for positioning over a point of support, for rotatably suspending said sheath means and said container from said point of support, said hanger means including:

(1) a substantially flat and elongated member, said elongated member having a cutaway area therein defining said arcuate opening;

(2) a flange disposed at one end of said elongated member, said flange being disposed adjacent said bore and said sheath means and being larger in area than said bore;

(3) a post member extending outwardly from said flange; and (4) arm means, connected to and biased outwardly from said post member, for maintaining said hanger means rotatably attached to said sheath means after said post member is placed in said bore and said arm means is urged past said sheath means, with said bias of said arm means allowing said arm means to move toward said post member as said post is urged through said bore and said bias positioning said arm means away from said post member and adjacent said sheath means when said post member is completely past said bore.

4. An apparatus for suspending a bottle of nail polish from a display bar, said bottle having a removable cap, said apparatus comprising:

sheath means, attached to and encircling said cap, for attaching said apparatus to said bottle, said sheath means including an upper portion defining a sheath aperture over said cap, said sheath means including a generally thin and rigid shroud enclosing the top and side portions of said cap, said shroud being attached to the side of said cap and forming a chamber including a central bore over said cap;

hanger means, attached to said sheath aperture, for rotatably suspending said sheath means from a display bar, a portion of said hanger means being cut away for positioning over said bar, said hanger means including an elongated member having a flange disposed at one end and a threaded member projecting from said flange, whereby said hanger is attached to said sheath means by urging the threads on said threaded member past said sheath aperture, whereupon said upper portion of said sheath means is disposed for free rotation between said flange and said threads; and means for indicating the color of the nail polish in said bottle, said indicating means comprising a disc of generally the same color as said nail polish and attached to said hanger means.

5. An apparatus for suspending a bottle of nail polish from a display bar, said bottle having a removable cap, said apparatus comprising:

sheath means, attached to and encircling said cap, for attaching said apparatus to said bottle, said sheath means including an upper portion defining a sheath aperture over said cap, hanger means, attached to said sheath aperture, for rotatably suspending said sheath means from a display bar, a portion of said hanger means being cut away for positioning over said bar, said sheath means including a generally thin and rigid shroud enclosing the top and side portions of said cap, said shroud being attached to the side of said cap and forming a chamber including a central bore over said cap;

said hanger means including an elongated member having a flange disposed at one end and a post member with a pair of outwardly biased arm members projecting from said flange, whereby said hanger is attached to said sheath means by urging said arms on said post member past said sheath aperture, whereupon said upper portion of said sheath means is disposed for free rotation between said flange and said arm members, with said bias on said arm members allowing said arm members to move against said post member as said post member is urged past said sheath aperture, and said bias positioning said arm member against said rigid shroud to maintin said hanger means attached to said sheath means; and means for indicating the color of the nail polish in said bottle, said indicating means comprising a disc of generally the same color as said nail polish and attached to said hanger means.

* * * * *